US011719050B2

(12) United States Patent
Russell et al.

(10) Patent No.: US 11,719,050 B2
(45) Date of Patent: Aug. 8, 2023

(54) CUTTING ELEMENTS FOR EARTH-BORING TOOLS AND RELATED EARTH-BORING TOOLS AND METHODS

(71) Applicant: Baker Hughes Oilfield Operations LLC, Houston, TX (US)

(72) Inventors: Steven Craig Russell, Spring, TX (US); Stephen Duffy, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 15 days.

(21) Appl. No.: 17/349,661

(22) Filed: Jun. 16, 2021

(65) Prior Publication Data

US 2022/0403704 A1 Dec. 22, 2022

(51) Int. Cl.
*E21B 10/43* (2006.01)

(52) U.S. Cl.
CPC ..... *E21B 10/43* (2013.01)

(58) Field of Classification Search
CPC ..... E21B 10/56; E21B 10/567; E21B 10/46; E21B 10/62; E21B 10/50; E21B 10/627; E21B 10/633; E21B 10/43
See application file for complete search history.

(56) References Cited

U.S. PATENT DOCUMENTS 4,109,737 A 8/1978 Bovenkerk
4,529,048 A 7/1985 Hall
4,570,726 A 2/1986 Hall
4,593,777 A 6/1986 Barr
4,872,520 A 10/1989 Nelson
5,333,699 A 8/1994 Thigpen et al.
5,377,773 A 1/1995 Tibbitts
5,437,343 A 8/1995 Cooley et al.
5,467,836 A 11/1995 Grimes et al.
5,499,688 A 3/1996 Dennis
(Continued)

FOREIGN PATENT DOCUMENTS

CN 205778558 U 12/2016
EP 0841463 B1 3/2004
(Continued)

OTHER PUBLICATIONS

International Search Report for International Application No. PCT/US20/16826, dated Apr. 14, 2020, 2 pages.
(Continued)

*Primary Examiner* — Caroline N Butcher
(74) *Attorney, Agent, or Firm* — TraskBritt

(57) ABSTRACT

Cutting elements for earth-boring tools may include a rotationally leading end positioned and configured to engage with, and remove, a material of an earth formation. A transition region may extend from proximate to a periphery of the cutting element radially inward and axially toward the rotationally leading end. The transition region may include first faceted surfaces, each first faceted surface extending at a first angle relative to a central geometric axis of the cutting element. The transition region may also include second faceted surfaces, each second faceted surface extending at a second, different angle relative to the central geometric axis of the cutting element. The first faceted surfaces and the second faceted surfaces may intersect one another at edges around a periphery of the transition region.

18 Claims, 8 Drawing Sheets

(56) References Cited

U.S. PATENT DOCUMENTS

| | | | |
|---|---|---|---|
| 5,871,060 | A | 2/1999 | Jensen et al. |
| 5,881,830 | A | 3/1999 | Cooley |
| 6,045,440 | A | 4/2000 | Johnson et al. |
| 6,065,554 | A | 5/2000 | Taylor et al. |
| 6,196,340 | B1 | 3/2001 | Jensen et al. |
| 6,202,770 | B1 | 3/2001 | Tibbitts |
| 6,481,952 | B2 | 11/2002 | Deutschle et al. |
| 6,510,910 | B2 | 1/2003 | Eyre et al. |
| 6,513,608 | B2 * | 2/2003 | Eyre ..... E21B 10/5735 175/433 |
| 6,550,556 | B2 | 4/2003 | Middlemiss et al. |
| 7,363,992 | B2 | 4/2008 | Stowe et al. |
| 7,726,420 | B2 | 6/2010 | Shen et al. |
| 7,757,785 | B2 | 7/2010 | Zhang et al. |
| 7,798,257 | B2 | 9/2010 | Shen et al. |
| 8,037,951 | B2 | 10/2011 | Shen et al. |
| 8,113,303 | B2 | 2/2012 | Zhang et al. |
| 8,191,656 | B2 | 6/2012 | Dourfaye et al. |
| 8,360,175 | B2 | 1/2013 | Fan et al. |
| 8,783,387 | B2 | 7/2014 | Durairajan et al. |
| 8,833,492 | B2 | 9/2014 | Durairajan et al. |
| RE45,748 | E | 10/2015 | Zhang et al. |
| 9,441,422 | B2 | 9/2016 | DiSantis |
| 9,598,909 | B2 | 3/2017 | Patel |
| 9,650,837 | B2 | 5/2017 | Patel et al. |
| 10,022,840 | B1 | 7/2018 | Miess |
| 10,125,552 | B2 | 11/2018 | Zhao et al. |
| 10,240,399 | B2 | 3/2019 | Rahmani |
| 10,287,825 | B2 | 5/2019 | Chen et al. |
| 10,309,156 | B2 | 6/2019 | Azar et al. |
| 10,378,289 | B2 | 8/2019 | Stockey |
| 10,550,644 | B2 | 2/2020 | Drews et al. |
| 10,570,668 | B2 | 2/2020 | Izbinski et al. |
| 10,605,010 | B2 | 3/2020 | De Maindreville et al. |
| 10,753,157 | B2 | 8/2020 | Rahmani |
| 10,794,118 | B2 | 10/2020 | Azar et al. |
| 10,801,268 | B2 | 10/2020 | Rahmani et al. |
| 10,907,416 | B2 | 2/2021 | Cheng et al. |
| 11,035,177 | B2 | 6/2021 | Dubose et al. |
| 11,060,356 | B2 | 7/2021 | Cuillier De Maindreville et al. |
| 11,091,960 | B2 | 8/2021 | Zhang et al. |
| 11,098,532 | B2 | 8/2021 | Gan et al. |
| 11,208,849 | B2 | 12/2021 | Rahmani et al. |
| 11,255,129 | B2 | 2/2022 | Dubose et al. |
| 2001/0030063 | A1 | 10/2001 | Dykstra et al. |
| 2002/0108791 | A1 | 8/2002 | Eyre et al. |
| 2003/0158018 | A1 | 8/2003 | Giannelli et al. |
| 2004/0097532 | A1 | 5/2004 | Jesudason et al. |
| 2004/0163851 | A1 | 8/2004 | McDonough et al. |
| 2005/0269139 | A1 | 12/2005 | Shen et al. |
| 2006/0210364 | A1 | 9/2006 | Bellmann et al. |
| 2008/0190666 | A1 | 8/2008 | Gatell |
| 2010/0059287 | A1 | 3/2010 | Durairajan et al. |
| 2010/0300765 | A1 | 12/2010 | Zhang et al. |
| 2011/0031030 | A1 | 2/2011 | Shen et al. |
| 2013/0068534 | A1 | 3/2013 | Digiovanni et al. |
| 2013/0306377 | A1 | 11/2013 | Digiovanni et al. |
| 2016/0069140 | A1 | 3/2016 | Patel et al. |
| 2017/0037518 | A1 * | 2/2017 | Oxford ..... C23C 24/103 |
| 2017/0234078 | A1 | 8/2017 | Patel et al. |
| 2018/0148978 | A1 | 5/2018 | Chen |
| 2018/0274303 | A1 | 9/2018 | Song et al. |
| 2018/0320450 | A1 | 11/2018 | Borge |
| 2018/0355672 | A1 | 12/2018 | De et al. |
| 2019/0040689 | A1 | 2/2019 | Liang et al. |
| 2019/0112877 | A1 | 4/2019 | Gan et al. |
| 2020/0157890 | A1 * | 5/2020 | Cuillier De Maindreville ..... E21B 10/55 |
| 2020/0347680 | A1 | 11/2020 | Tian et al. |
| 2021/0131190 | A1 * | 5/2021 | Rahmani ..... E21B 10/5673 |
| 2021/0156202 | A1 | 5/2021 | Gan et al. |
| 2021/0164296 | A1 | 6/2021 | Zhao et al. |
| 2021/0172258 | A1 | 6/2021 | Graham et al. |
| 2021/0180409 | A1 | 6/2021 | Davila et al. |
| 2021/0215003 | A1 | 7/2021 | Mahajan et al. |
| 2021/0277722 | A1 | 9/2021 | Liu et al. |
| 2021/0370419 | A1 | 12/2021 | Yu et al. |
| 2021/0372203 | A1 | 12/2021 | Eyre et al. |
| 2021/0381318 | A1 | 12/2021 | Gan et al. |
| 2022/0003046 | A1 | 1/2022 | Yu et al. |
| 2022/0074271 | A1 | 3/2022 | Rahmani et al. |
| 2022/0112773 | A1 | 4/2022 | Chen et al. |

FOREIGN PATENT DOCUMENTS

| | | | |
|---|---|---|---|
| KR | 10-2015-0096542 | A | 8/2015 |
| WO | 2018/231343 | A1 | 12/2018 |
| WO | 2020/102016 | A1 | 5/2020 |
| WO | 2020/131421 | | 6/2020 |
| WO | 2020/245165 | A1 | 12/2020 |
| WO | 2020/245223 | A1 | 12/2020 |
| WO | 2021/041753 | A1 | 3/2021 |
| WO | 2021/080900 | A1 | 4/2021 |
| WO | 2021/091836 | A1 | 5/2021 |
| WO | 2021/142188 | A | 7/2021 |
| WO | 2021/178304 | A1 | 10/2021 |
| WO | 2021/243361 | A1 | 12/2021 |
| WO | 2021/243362 | A1 | 12/2021 |

OTHER PUBLICATIONS

International Search Report for International Application No. PCT/US20/16839, dated Apr. 14, 2020, 2 pages.

International Written Opinion for International Application No. PCT/US20/16826, dated Apr. 14, 2020, 5 pages.

International Written Opinion for International Application No. PCT/US20/16839, dated Apr. 14, 2020, 5 pages.

International Search Report for International Application No. PCT/US2022/072947 dated Oct. 14, 2022, 3 pages.

International Written Opinion for International Application No. PCT/US2022/072947 dated Oct. 14, 2022, 4 pages.

* cited by examiner

CUTTING ELEMENTS FOR EARTH-BORING TOOLS AND RELATED EARTH-BORING TOOLS AND METHODS

FIELD

This disclosure relates generally to cutting elements for earth-boring tools and related earth-boring tools and methods. More specifically, disclosed embodiments relate to geometries for cutting elements for earth-boring tools which may exhibit longer useful life, exhibit higher durability, and require lower energy input to achieve a target depth of cut and/or rate of penetration.

BACKGROUND

Earth-boring tools for forming wellbores in subterranean earth formations may include cutting elements secured to a body. For example, fixed-cutter earth-boring rotary drill bits (also referred to as "drag bits") include cutting elements fixedly attached to a bit body of the drill bit. Similarly, roller cone earth-boring rotary drill bits may include cones mounted on bearing pins extending from legs of a bit body, such that each cone is capable of rotating about the bearing pin on which it is mounted. Cutting elements may be mounted to each cone of the drill bit. Rotation of the bit body while applying weight to the drill bit in either such embodiment may cause the cutting elements to contact, penetrate, and remove material from an earth formation.

The cutting elements used in such earth-boring tools often include polycrystalline diamond compact (often referred to as "PDC") cutting elements, also termed "cutters." These cutting elements conventionally include a polycrystalline diamond (PCD) material, which may be characterized as a superabrasive or superhard material. Such polycrystalline diamond materials are formed by sintering and bonding together relatively small synthetic, natural, or a combination of synthetic and natural diamond grains or crystals, termed "grit." Sintering occurs under conditions of high temperature and high pressure in the presence of a catalyst, such as, for example, cobalt, iron, nickel, or alloys and mixtures thereof, to form a layer of polycrystalline diamond material, also called a "diamond table." These processes are often referred to as high temperature/high pressure ("HTHP") processes.

The cutting element substrate may include a ceramic-metal composite material (a "cermet"), such as, for example, cobalt-cemented tungsten carbide. In some instances, the polycrystalline diamond table may be formed on the cutting element, for example, during the HTHP sintering process. In such instances, cobalt or other catalyst material in the cutting element substrate may be swept into the diamond grains or crystals during sintering and serve as a catalyst material for forming a diamond table from the diamond grains or crystals. Powdered catalyst material may also be mixed with the diamond grains or crystals prior to sintering the grains or crystals together in an HTHP process. In other methods, however, the diamond table may be formed separately from the cutting element substrate and subsequently attached thereto.

BRIEF SUMMARY

In some embodiments, cutting elements for earth-boring tools may include a rotationally leading end positioned and configured to engage with, and remove, a material of an earth formation. A transition region may extend from proximate to a periphery of the cutting element radially inward and axially toward the rotationally leading end. The transition region may include first faceted surfaces, each first faceted surface extending at a first angle relative to a central geometric axis of the cutting element. The transition region may also include second faceted surfaces, each second faceted surface extending at a second, different angle relative to the central geometric axis of the cutting element. The first faceted surfaces and the second faceted surfaces may intersect one another at edges around a periphery of the transition region.

In other embodiments, earth-boring tools may include cutting elements secured to a body. At least one of the cutting elements may include a rotationally leading end positioned and configured to engage with, and remove, a material of an earth formation. A transition region may extend from proximate to a periphery of the cutting element radially inward and axially toward the rotationally leading end. The transition region may include first faceted surfaces, each first faceted surface extending at a first angle relative to a central geometric axis of the cutting element. The transition region may also include second faceted surfaces, each second faceted surface extending at a second, different angle relative to the central geometric axis of the cutting element. The first faceted surfaces and the second faceted surfaces may intersect one another at edges around a periphery of the transition region.

In other embodiments, methods of making cutting elements for earth-boring tools may involve forming first faceted surfaces in a transition region extending from proximate to a periphery of the cutting element radially inward and axially toward a rotationally leading end of the cutting element. Each first faceted surface may extend at a first angle relative to a central geometric axis of the cutting element. The rotationally leading end may be positioned and configured to engage with, and remove, a material of an earth formation. The method may also involve forming second faceted surfaces in the transition region, each second faceted surface extending at a second, different angle relative to the central geometric axis of the cutting element. The first faceted surfaces and the second faceted surfaces may intersect one another at edges around a periphery of the transition region.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings. In the drawings:

DETAILED DESCRIPTION

Figure 1:
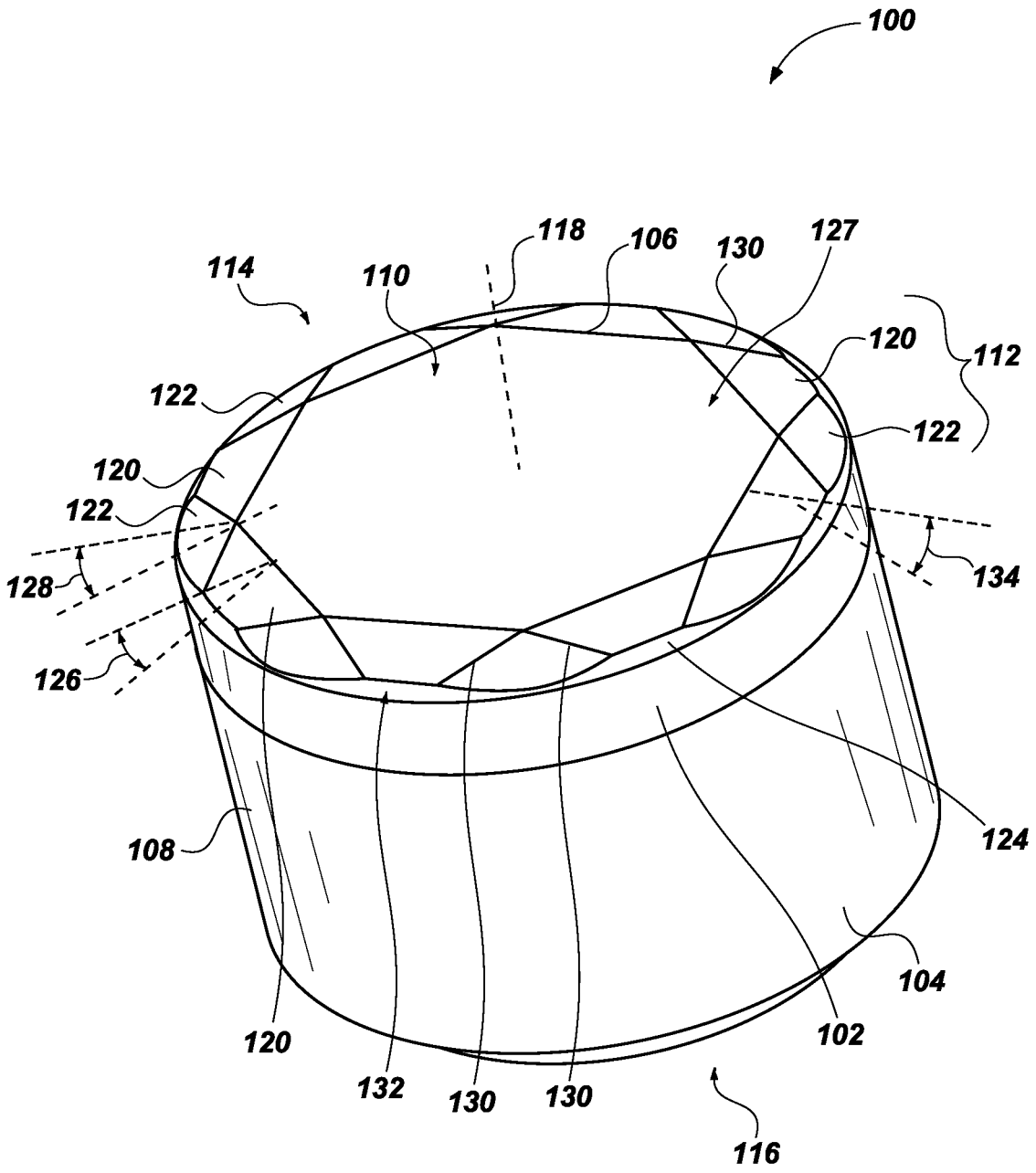
FIG. 1 is a perspective side view of a cutting element in accordance with this disclosure.

The illustrations presented in this disclosure are not meant to be actual views of any particular cutting element, earth-boring tool, or component thereof, but are merely idealized representations employed to describe illustrative embodiments. Thus, the drawings are not necessarily to scale.

Disclosed embodiments relate generally to geometries for cutting elements for earth-boring tools which may exhibit longer useful life, exhibit higher durability, and require lower energy input to achieve a target depth of cut and/or rate of penetration. More specifically, disclosed are embodiments of geometries for cutting elements where a transition region may include faceted surfaces. For example, the transition region may be located proximate to a rotationally leading end of a cutting element, and may provide a sloping transition from a cutting edge radially outward toward a periphery of the cutting element and axially toward a rotationally trailing end of the cutting element. That transition region may include first faceted surfaces extending at a first angle relative to a central geometric axis of the cutting element. The transition region may also include second faceted surfaces extending at a second angle, different from the first angle, relative to the central geometric axis.

In some embodiments, the first faceted surfaces and the second faceted surfaces may intersect with a cutting face at the rotationally leading end in such a way that the cutting edge at the periphery of the cutting face forms a polygonal shape. For example, the first faceted surfaces may extend from sides of the polygonal shape, and the second faceted surfaces may extend from nodes of the polygonal shape. As another example, the first faceted surfaces may extend from some of the sides of the polygonal shape, and the second faceted surfaces may extend from other sides of the polygonal shape.

In some embodiments, the cutting element may include another transition region extending from the transition region having the first faceted surfaces and the second faceted surfaces radially outward to the periphery of the cutting element and axially farther toward the rotationally trailing end. The other transition region may be continuous or discontinuous about the perimeter of the cutting element.

In some embodiments, the cutting element may include a recess proximate to the central geometric axis. For example, the recess may be defined at least partially by additional faceted surfaces. As another example, a shape of a perimeter of the recess may be at least substantially the same as, or different from, the shape of the perimeter of the cutting edge and/or the cutting element.

Cutting elements including the above and additional features disclosed herein may, for example, exhibit longer useful life, exhibit higher durability, and require lower energy input to achieve a target depth of cut and/or rate of penetration. More specifically, cutting elements in accordance with this disclosure may have higher efficiency, enabling the cutting elements to achieve target performance for a longer period of time and with less energy input when compared to conventional geometries for cutting elements.

As used herein, the terms "substantially" and "about" in reference to a given parameter, property, or condition means and includes to a degree that one of ordinary skill in the art would understand that the given parameter, property, or condition is met with a degree of variance, such as within acceptable manufacturing tolerances. For example, a parameter that is substantially or about a specified value may be at least about 90% the specified value, at least about 95% the specified value, at least about 99% the specified value, or even at least about 99.9% the specified value.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., bits including rolling components in combination with fixed cutting elements), and other drilling bits and tools known in the art.

As used herein, the term "superabrasive material" means and includes any material having a Knoop hardness value of about 3,000 Kgf/mm2 (29,420 MPa) or more. Superabrasive materials include, for example, diamond and cubic boron nitride. Superabrasive materials may also be referred to as "superhard" materials.

As used herein, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "interbonded" mean and include any direct atomic bond (e.g., covalent, metallic, etc.) between atoms in adjacent grains of superabrasive material.

As used herein, terms of relative positioning, such as "above," "over," "under," and the like, refer to the orientation and positioning shown in the figures. During real-world formation and use, the structures depicted may take on other orientations (e.g., may be inverted vertically, rotated about any axis, etc.). Accordingly, the descriptions of relative positioning must be reinterpreted in light of such differences in orientation (e.g., resulting in the positioning structures described as being located "above" other structures underneath or to the side of such other structures as a result of reorientation).

FIG. 1 is a perspective side view of a cutting element 100 in accordance with this disclosure. The cutting element 100 may include a polycrystalline, superabrasive material 102 secured to an end of a substrate 104, in some embodiments. In other embodiments, the cutting element 100 may include a monolithic mass of material (e.g., a ceramic, a metal, an alloy) or a monolithic composite material (e.g., a ceramic-metallic composite material) suitable for use in the downhole environment. As a specific, nonlimiting, alternative example, the cutting element 100 may include a mass of cobalt-cemented tungsten carbide particle matrix composite material, optionally impregnated with particles of a superabrasive or polycrystalline, superabrasive material, shaped as a cutting element (often termed an "insert") for an earth-boring tool.

The cutting element 100 may include a cutting edge 106 located proximate to a periphery 108 of the cutting element 100. For example, the cutting edge 106 may be positioned and configured to contact an earth formation during an earth-boring operation wherein the cutting element 100 is used to contact and remove material from an underlying earth formation. More specifically, a rotationally leading end 114 of the cutting element 100 may be positioned and configured to engage with, and remove, a material of an earth formation. In the embodiment of FIG. 1, the cutting edge 106 is located at an intersection between a cutting face 110 and a transition region 112 proximate to the rotationally leading end 114 of the cutting element 100, and distal from the substrate 104 at the rotationally trailing end 116. The cutting face 110 may be configured as, for example, a generally planar surface oriented at least substantially perpendicular to a central geometric axis 118 of the cutting element 100 proximate to the rotationally leading end 114.

The transition region 112 may extend from proximate to the periphery 108 of the cutting element 100 radially inward and axially toward the rotationally leading end 114. For example, the transition region 112 may extend from the cutting edge 106 radially outward to another transition region 124 proximate to the periphery 108 of the cutting element 100, and from the cutting edge axially away from the rotationally leading end 114 to the other transition region 124 proximate to the substrate 104, as shown in FIG. 1. As another example, the transition region may extend from the cutting edge radially outward to the periphery of the cutting element, and from the cutting edge axially away from the rotationally leading end to the periphery of the cutting element proximate to the substrate.

The transition region 112 may include first faceted surfaces 120, each first faceted surface 120 extending at a first angle 126 relative to a plane 127 perpendicular to the central geometric axis 118 of the cutting element. For example, the first faceted surfaces 120 may include planar surfaces of the material of the cutting element 100 exposed proximate to the rotationally leading end 114. The first faceted surfaces 120 may intersect with the cutting face 110 to form portions of the cutting edge 106, and may otherwise be bounded by edges on remaining sides of the first faceted surfaces 120. The first faceted surfaces 120 may be configured as, for example, chamfered surfaces extending along respective portions of the perimeter of the cutting edge 106.

The transition region 112 may also include second faceted surfaces 122, each second faceted surface 122 extending at second angle 128, different from the first angle 126, relative to the plane 127 perpendicular to the central geometric axis 118 of the cutting element 100. For example, the second faceted surfaces 122 may include planar surfaces of the material of the cutting element 100 exposed proximate to the rotationally leading end 114. The second faceted surfaces 122 may intersect with the cutting face 110 to form other portions of the cutting edge 106 (e.g., remaining portions of the cutting edge 106), and may otherwise be bounded by edges on remaining sides of the second faceted surface 122. The second faceted surfaces 122 may be configured as, for example, chamfered surfaces extending along other respective portions of the perimeter of the cutting edge 106.

The first faceted surfaces 120 and the second faceted surfaces 122 may intersect with one another at edges around a periphery of the transition region 112. For example, the first faceted surfaces 120 and the second faceted surfaces 122 may intersect with one another at their angular boundaries around the perimeter of the cutting edge 106. More specifically, the first faceted surfaces 120 and the second faceted surface 122 may extend, for example, circumferentially around the transition region 112 to intersect at the edges 130, which may be oriented so as to not intersect with the central geometric axis 118.

In some embodiments, the cutting element 100 may include another transition region 124 extending from the periphery of the cutting element 100 radially inward to the transition region 112. For example, the other transition region 124 may extend from an intersection with the transition region 112 radially outward to the periphery 108 of the cutting element 100, and from the intersection with the transition region 112 axially toward the rotationally trailing end 116, such as to the periphery 108 of the cutting element 100 proximate to the substrate 104, as shown in FIG. 1.

The other transition region 124 may include another transition surface 132 oriented at a third angle 134, different from the first angle 126 and the second angle 128, relative to the central geometric axis 118 of the cutting element 100. For example, the other transition surface 132 may include one or more curved surfaces of the material of the cutting element 100 exposed proximate to the rotationally leading end 114.

Figure 2:
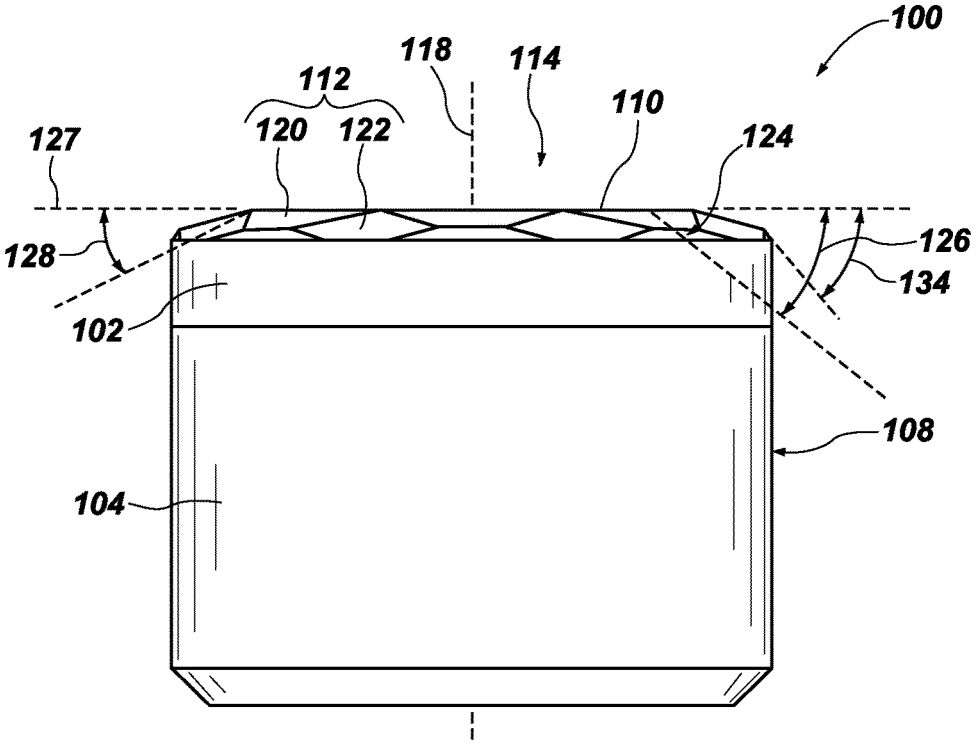
FIG. 2 is a side view of the cutting element of FIG. 1.

FIG. 2 is a side view of the cutting element 100 of FIG. 1. In some embodiments, the other transition region 124 may be discontinuous about the periphery 108 of the cutting element 100, as shown in FIG. 2. For example, each first faceted surface 120 of the transition region 112 of the cutting element 100 may extend radially outward and axially away from the rotationally leading end 114 to the other transition region 124. Each second faceted surface 122 may extend radially outward and axially away from the rotationally leading end 114 to the periphery 108 of the cutting element 100. More specifically, the other transition region 124 may be, for example, at least substantially angularly aligned with the first faceted surfaces 120, such that the other transition region 124 is located primarily in those circumferential locations where the first faceted surfaces 120 of the transition region 112 are also located, and the other transition region 124 and the first faceted surfaces 120 may be axially offset from one another. The other transition region 124 may be, for example, at least substantially angularly misaligned from the second faceted surfaces 122, such that the other transition region 124 is interrupted circumferentially by portions of the second faceted surfaces 122 extending to the periphery 108 of the cutting element 100, such that the other transition region 124 and the second faceted surface 122 may be axially and circumferentially offset from one another.

With joint reference to FIG. 1 and FIG. 2, the first angle 126 at which the first faceted surfaces 120 are oriented relative to the plane 127 perpendicular to the central geometric axis 118 (e.g., perpendicular to the cutting face 110) may be, for example, between about 10 degrees and about 65 degrees. More specifically, the first angle 126 may be, for example, between about 12.5 degrees and about 60 degrees. As a specific, nonlimiting example, the first angle 126 may be between about 15 degrees and about 55 degrees (e.g., about 20 degrees, about 30 degrees, about 40 degrees).

The second angle 128 at which the second faceted surfaces 122 are oriented relative to the plane 127 perpendicular to the central geometric axis 118 (e.g., perpendicular to the cutting face 110) may be, for example, greater than the first angle, and between about 20 degrees and about 75 degrees. More specifically, the second angle 128 may be, for example, between about 25 degrees and about 70 degrees. As a specific, nonlimiting example, the first angle 126 may be between about 30 degrees and about 60 degrees (e.g., about 40 degrees, about 45 degrees, about 50 degrees).

The third angle 134 at which the other transition surface 132 is oriented relative to the plane 127 perpendicular to the central geometric axis 118 (e.g., perpendicular to the cutting face 110) may be, for example, greater than the first angle 126 and the second angle 128 and between about 45 degrees and about 99 degrees. More specifically, the third angle 134 may be, for example, between about 50 degrees and about 95 degrees. As a specific, nonlimiting example, the third angle 134 may be between about 55 degrees and about 90 degrees (e.g., about 60 degrees, about 70 degrees, about 80 degrees).

Figure 3:
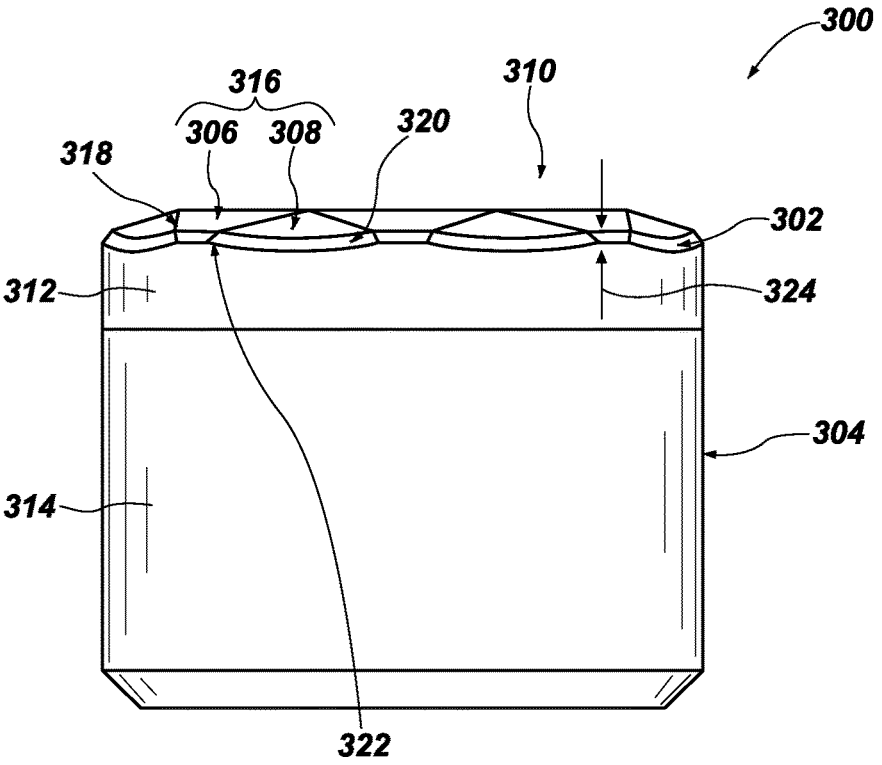
FIG. 3 is a side view of another embodiment of a cutting element.

FIG. 3 is a side view of another embodiment of a cutting element 300. In some embodiments, the other transition region 302 may be continuous about the periphery 304 of the cutting element 300, as shown in FIG. 3. For example, each first faceted surface 306 and each second faceted surface 308 of the transition region 316 may extend radially outward and axially away from the rotationally leading end 310 to the other transition region 302. More specifically, the other transition region 302 may extend, for example, at least substantially around an entirety of the periphery 304 of the cutting element 300, such that the other transition region 302 may be circumferentially and axially interposed between the first faceted surfaces 306 and the periphery 304 and between the second faceted surfaces 308 and the periphery 304. As a specific, nonlimiting example, the other transition region 302 may include alternating third faceted surfaces 318 and fourth faceted surfaces 320, with the first faceted surfaces 306 circumferentially aligned with, and axially offset from, the third faceted surfaces 318, and the fourth faceted surfaces 320 circumferentially aligned with, and axially offset from, the second faceted surfaces 308. The other transition region 302 may still be characterized as "continuous" about the periphery 304 of the cutting element 300, though edges 322 may be located at intersections between the third faceted surfaces 318 and the fourth faceted surfaces 320 of the other transition region 302.

In some embodiments where the other transition region 302 is at least substantially continuous about the periphery 304 of the cutting element 300, an axial thickness 324 of the other transition region 302 may be at least substantially constant around a perimeter of the other transition region 302. For example, a shortest distance from the substrate 314 to the intersection between the transition region 316 and the other transition region 302 may be at least substantially constant around the perimeter of that intersection, and a shortest distance from the substrate 314 to the intersection between the other transition region 302 and the periphery 304 of the cutting element 300 may likewise be at least substantially constant around the perimeter of that intersection.

Figure 4:
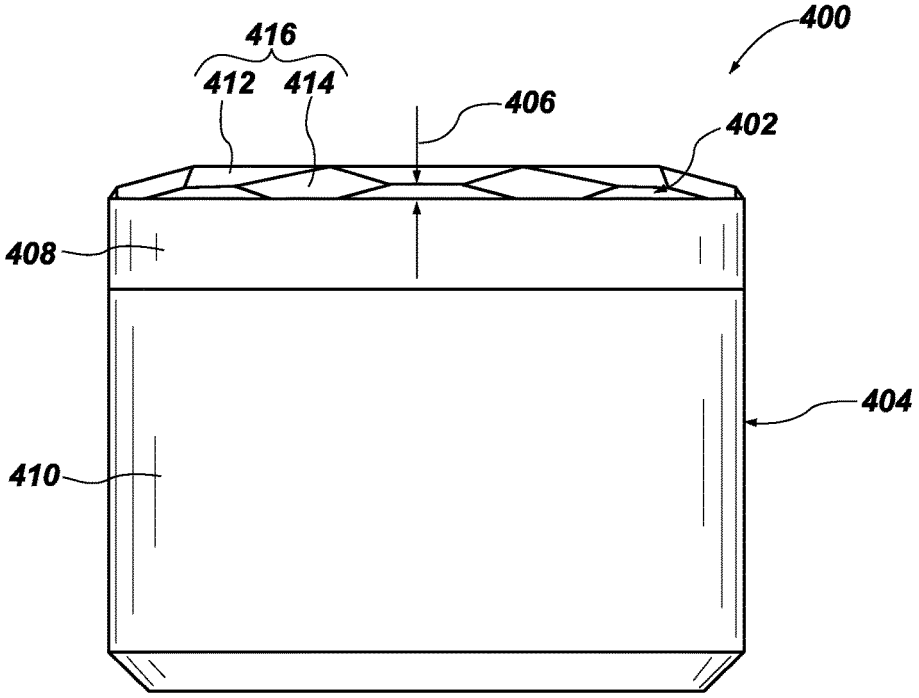
FIG. 4 is a side view of another embodiment of a cutting element.

FIG. 4 is a side view of another embodiment of a cutting element 400. In other embodiments where the other transition region 402 is at least substantially continuous about the periphery 404 of the cutting element 400, an axial thickness 406 of the other transition region 402 may vary around a perimeter of the other transition region 402, as shown in FIG. 4. For example, at least one of a shortest distance from the substrate 410 to the intersection between the transition region 416 and the other transition region 402 and/or a shortest distance from the substrate 410 to the intersection between the other transition region 402 and the periphery 404 of the cutting element 400 may vary with circumferential distance around the other transition region 402. More specifically, a shortest distance from the substrate 410 to the intersection between the transition region 416 and the other transition region 402 may vary around the perimeter of that intersection, and a shortest distance from the substrate 410 to the intersection between the other transition region 402 and the periphery 304 of the cutting element 300 may, for example, be at least substantially constant around the perimeter of that intersection.

Figure 5:
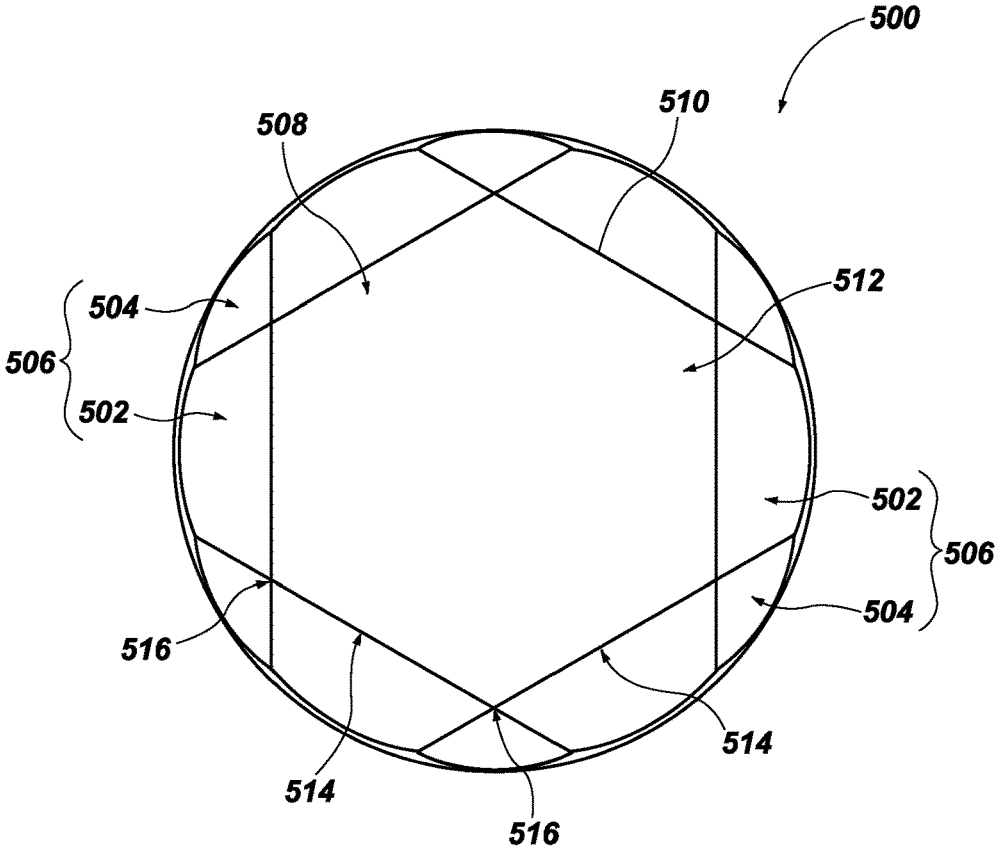
FIG. 5 is a top surface view of another embodiment of a cutting element.

FIG. 5 is a top surface view of another embodiment of a cutting element 500. In some embodiments, the first transition region 506 may extend from the cutting edge 510 defined at the intersection of the transition region 506 with the cutting face 508 at the rotationally leading end 512 in such a way that a perimeter of the cutting edge 510 defines a polygonal shape. For example, the polygonal shape defined by the cutting edge 510 at the intersection between the cutting face 508 and the transition region may be a hexagon, octagon, or decagon. More specifically, the polygonal shape defined by the cutting edge 510 at the intersection between the cutting face 508 and the transition region may be, for example, a hexagon, as shown in FIG. 5.

A number of the first faceted surfaces 502 may be, for example, equal to a number of sides 514 of the polygonal shape. For example, the number of the first faceted surfaces 502, and the corresponding number of sides 514 of the polygonal shape formed by the cutting edge 510, may be between about four and about twenty. More specifically, the number of the first faceted surfaces 502, and the corresponding number of sides 514 of the polygonal shape formed by the cutting edge 510, may be between about six and about twelve.

A number of the second faceted surfaces 504 may be, for example, equal to a number of nodes of the polygonal shape. For example, the number of the second faceted surfaces 504, and the corresponding number of nodes 516 of the polygonal shape formed by the cutting edge 510, may be between about four and about twenty. More specifically, the number of the second faceted surfaces 504, and the corresponding number of nodes 516 of the polygonal shape formed by the cutting edge 510, may be between about six and about twelve.

In some embodiments, each first faceted surface 502 may extend from a respective side 514 of the polygonal shape, and each second faceted surface 504 may extend from a respective node 516 of the polygonal shape. For example, the angles at which the first faceted surfaces 502 may extend, as well as the angular, radial, and axial positions where the first faceted surfaces 502 are deployed, may cause the sides 514 of the polygonal shape formed by the cutting edge 510 to be formed at intersections between the first faceted surfaces 502 and the cutting face 508. Continuing the example, the angles at which the second faceted surfaces 504 may extend, as well as the angular, radial, and axial positions where the second faceted surface 504 are deployed, may cause the nodes 516 of the polygonal shape formed by the cutting edge 510 to be formed at intersections between the second faceted surfaces 504 and the cutting face 508.

Figure 6:
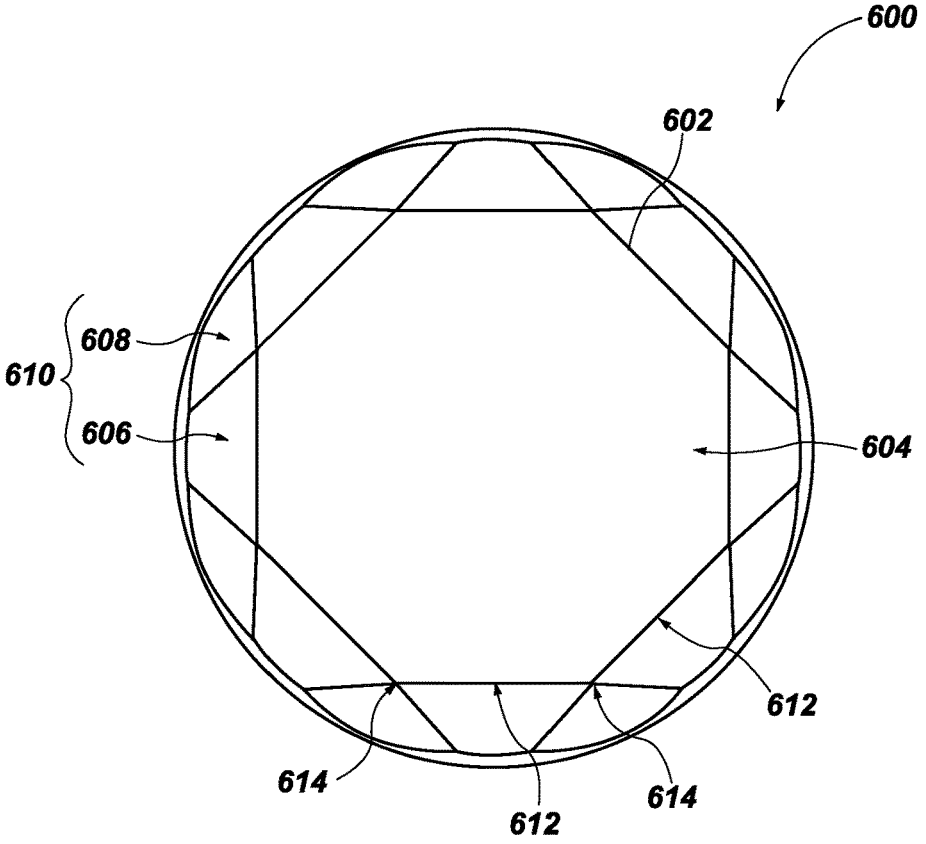
FIG. 6 is a top surface view of another embodiment of a cutting element.

FIG. 6 is a top surface view of another embodiment of a cutting element 600. In some embodiments, the polygonal shape defined by the cutting edge 602 at the intersection between the cutting face 604 and the transition region 610 may be an octagon, as shown in FIG. 6. For example, a number of sides 612 and nodes 614 of the polygonal shape defined by the cutting edge 602 may be eight, and the corresponding numbers of the first faceted surfaces 606 and the second faceted surfaces 608 may likewise be eight.

Figure 7:
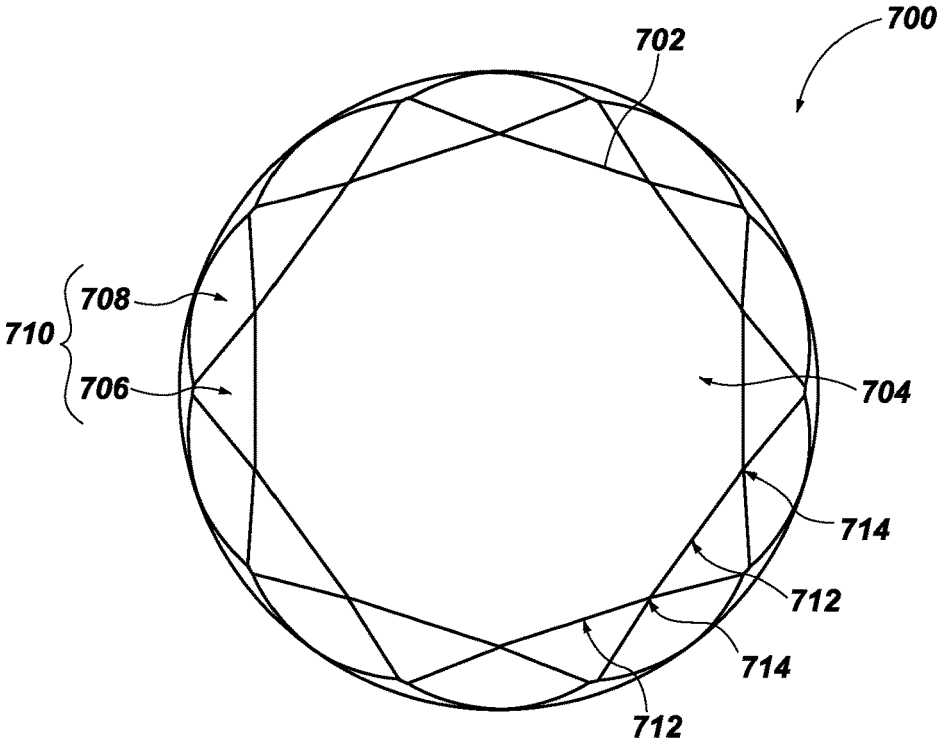
FIG. 7 is a top surface view of another embodiment of a cutting element.

FIG. 7 is a top surface view of another embodiment of a cutting element 700. In some embodiments, the polygonal shape defined by the cutting edge 702 at the intersection between the cutting face 704 and the transition region 710 may be a decagon, as shown in FIG. 7. For example, a number of sides 712 and nodes 714 of the polygonal shape defined by the cutting edge 702 may be ten, and the corresponding numbers of the first faceted surfaces 706 and the second faceted surfaces 708 may likewise be ten.

Figure 8:
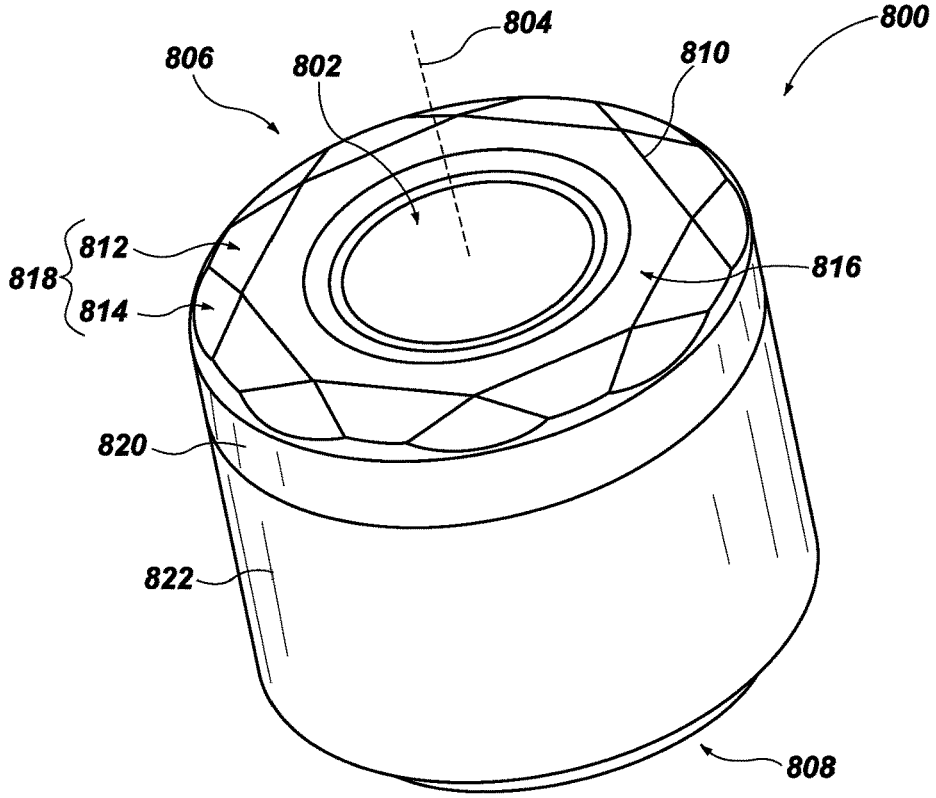
FIG. 8 is a perspective side view of another embodiment of a cutting element.

FIG. 8 is a perspective side view of another embodiment of a cutting element 800. In some embodiments, the cutting element 800 may include a recess 802 located proximate to the central geometric axis 804 of the cutting element 800 and extending from the rotationally leading end 806 toward a rotationally trailing end 808 of the cutting element 800. For example, the recess 802 may be located proximate to, and extend radially outward from, the central geometric axis 804. More specifically, the recess 802 may extend, for example, from the central geometric axis 804 radially outward to a location spaced from the cutting edge 810 defined at the intersection between the cutting face 816 and the transition region 818, such that the cutting face 816 may be radially interposed between the recess 802 and the cutting edge 810. The recess 802 may also, for example, be located proximate to, and extend axially away from, the rotationally leading end 806. More specifically, the recess 802 may extend, for example, from the cutting face 816 at the rotationally leading end 806 of the cutting element 800 axially toward the rotationally trailing end 808.

In some embodiments, a shape of a perimeter of the recess 802 may be at least substantially the same as a shape of a perimeter of the cutting element 800. For example, the cutting element 800 may generally be configured as a right cylinder, such that a perimeter of the cutting element 800 may at least substantially form a circle. The perimeter of the recess 802 in some such embodiments may likewise at least substantially form a circle. For example, the recess 802 may generally be shaped as an inverse dome extending from the cutting face 816 into the material of the cutting element 800 (e.g., into and only partially through an axial thickness of the polycrystalline, superabrasive material 820 supported on the substrate 822).

Figure 9:
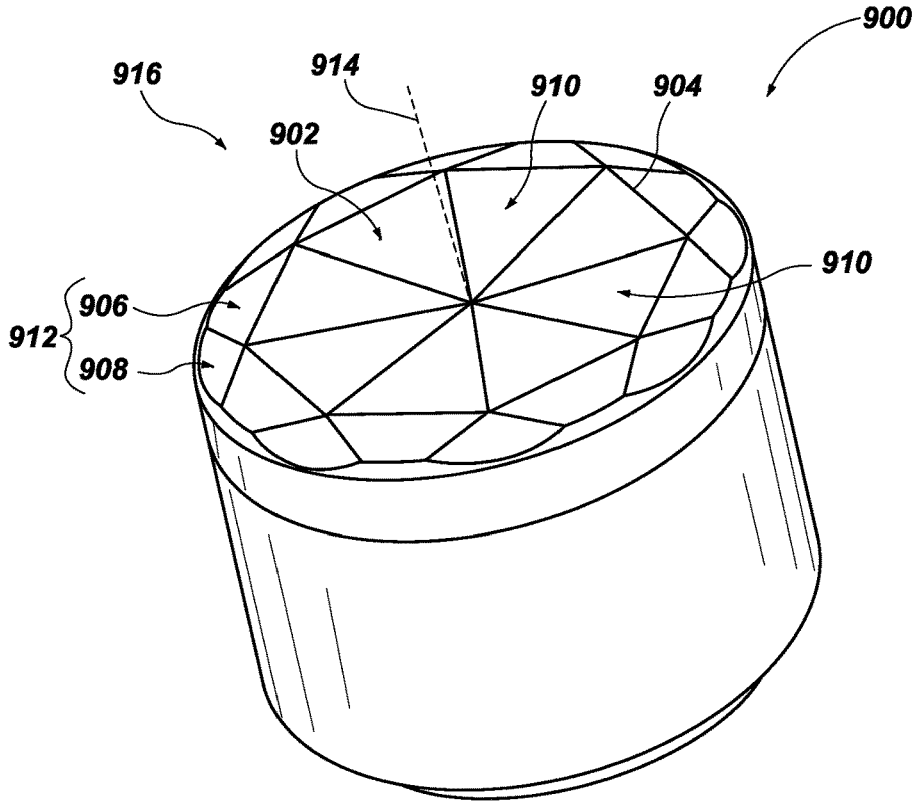
FIG. 9 is a perspective side view of another embodiment of a cutting element.

FIG. 9 is a perspective side view of another embodiment of a cutting element 900. In some embodiments, the recesses 902 may include fifth faceted surfaces 910 distributed around the central geometric axis 914. For example, the recess 902 may include at least substantially planar, fifth faceted surfaces 910 extending at an oblique angle relative to the central geometric axis 914 radially outward from the central geometric axis 914 and axially toward the rotationally leading end 916 as distance from the central geometric axis 914 increases. More specifically, a number of fifth faceted surfaces 910, for example, equal to a number of sides of the polygonal shape defined by the cutting edge 904 may extend from a lowest portion of the recess 902 at the central geometric axis 914 radially outward and axially toward the rotationally leading end 916 to form a recess 902 having a same number of fifth faceted surfaces 910 as the number of first faceted surfaces 906 of the transition region 912. As a specific, nonlimiting example, the fifth faceted surfaces 910 may be configured as triangular shapes converging at, and distributed around, the central geometric axis 914, with the fifth faceted surfaces 910 extending axially closer to the rotationally leading end 916 as distance from the central geometric axis 914 increases.

In some embodiments, the cutting element 900 may lack a cutting face in the form of a planar surface proximate to the rotationally leading end 916 of the cutting element 900. For example, the cutting edge 904 may be formed at the intersection between the surfaces defining the recess 902 and the surfaces defining the transition region 912. More specifically, the fifth faceted surfaces 910 of the recess 902 may extend radially from the central geometric axis 914 outward, and the first faceted surfaces 906, the second faceted surface 908, or the first faceted surface 906 and the second faceted surface 908 of the transition region 912 may extend radially inward to intersect with the fifth faceted surfaces 910 to form the cutting edge 904. In such a configuration, the cutting edge 904 itself may be the most rotationally leading feature of the cutting element 900 proximate to the rotationally leading end 916.

Figure 10:
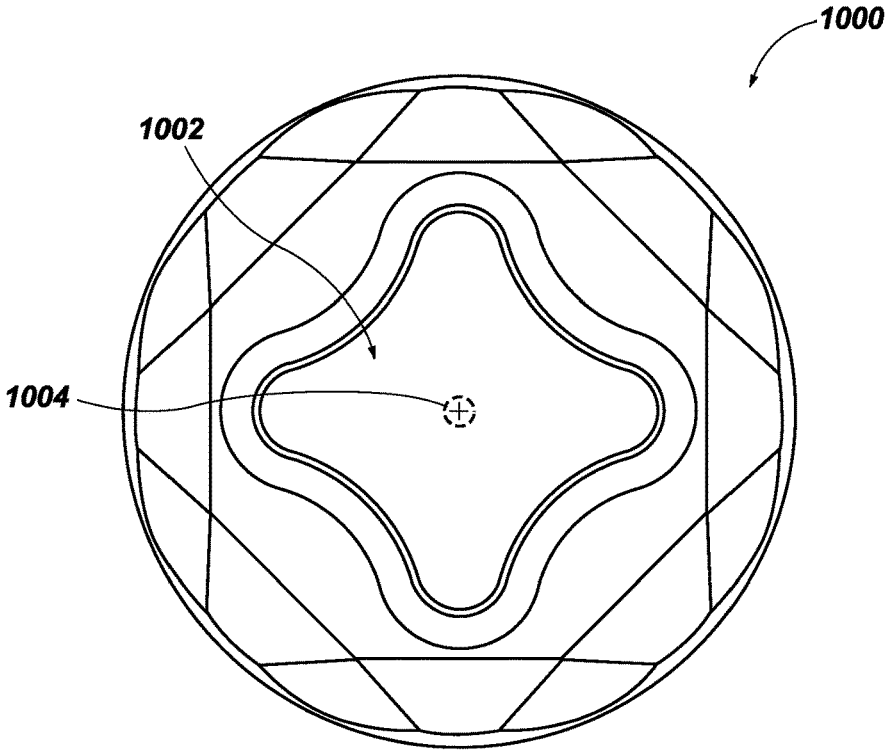
FIG. 10 is a top surface view of another embodiment of a cutting element.

FIG. 10 is a top surface view of another embodiment of a cutting element 1000. In some embodiments, a shape of a perimeter of the recess 1002 may be different from a shape of a perimeter of the cutting element 1000. For example, the perimeter of the cutting element 1000 may be at least substantially circular or oval-shaped, and the perimeter of the recess 1002 may be noncircular or non-oval-shaped. More specifically, the perimeter of the cutting element 1000 may be, for example, at least substantially circular or oval-shaped, and the perimeter of the recess 1002 may have a polygonal shape, a noncircular or non-oval shape that is rotationally symmetrical about the central geometric axis 1004 of the cutting element 1000. As a specific, nonlimiting example, the perimeter of the cutting element 1000 may be, for example, at least substantially circular or oval-shaped, and the perimeter of the recess 1002 may resemble a square having rounded corners and concave sides (e.g., a superellipse having rounded corners), as shown in FIG. 10.

Figure 11:
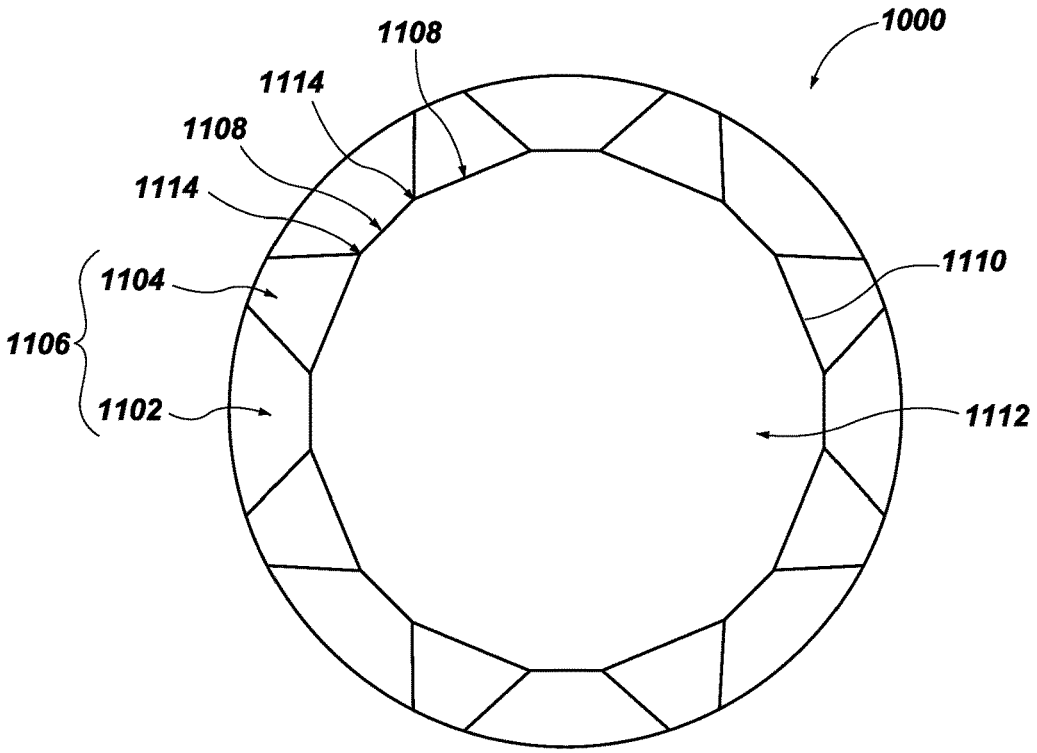
FIG. 11 is a top surface view of another embodiment of a cutting element.

FIG. 11 is a top surface view of another embodiment of a cutting element 1100. In some embodiments, a number of each of the first faceted surfaces 1102 and the second faceted surfaces 1104 may be, for example, equal to a number of sides 1108 of the polygonal shape defined by the perimeter of the cutting edge 1110. For example, the number of the first faceted surfaces 1102, a number of the second faceted surfaces 1104, and the corresponding number of sides 1108 of the polygonal shape formed by the cutting edge 1110, may be between about four and about twenty. More specifically, the number of the first faceted surfaces 1102, the number of the second faceted surfaces 1104, and the corresponding number of sides 1108 of the polygonal shape formed by the cutting edge 1110, may be between about six and about twelve.

In some embodiments, each first faceted surface 1102 and each second faceted surface 1104 may extend from a respective side 1108 of the polygonal shape. For example, the angles at which the first faceted surfaces 1102 and the second faceted surfaces 1104 may extend, as well as the angular, radial, and axial positions where the first faceted surfaces 1102 and the second faceted surfaces 1104 are deployed, may cause the sides 1108 of the polygonal shape formed by the cutting edge 1110 to be formed at intersections between the first faceted surfaces 1102 and the cutting face 1112. In some such embodiments, the cutting element 1100 may lack any faceted surfaces extending only from the nodes 1114 of the polygonal shape defined by the cutting edge 1110 of the cutting element 1100.

Figure 12:
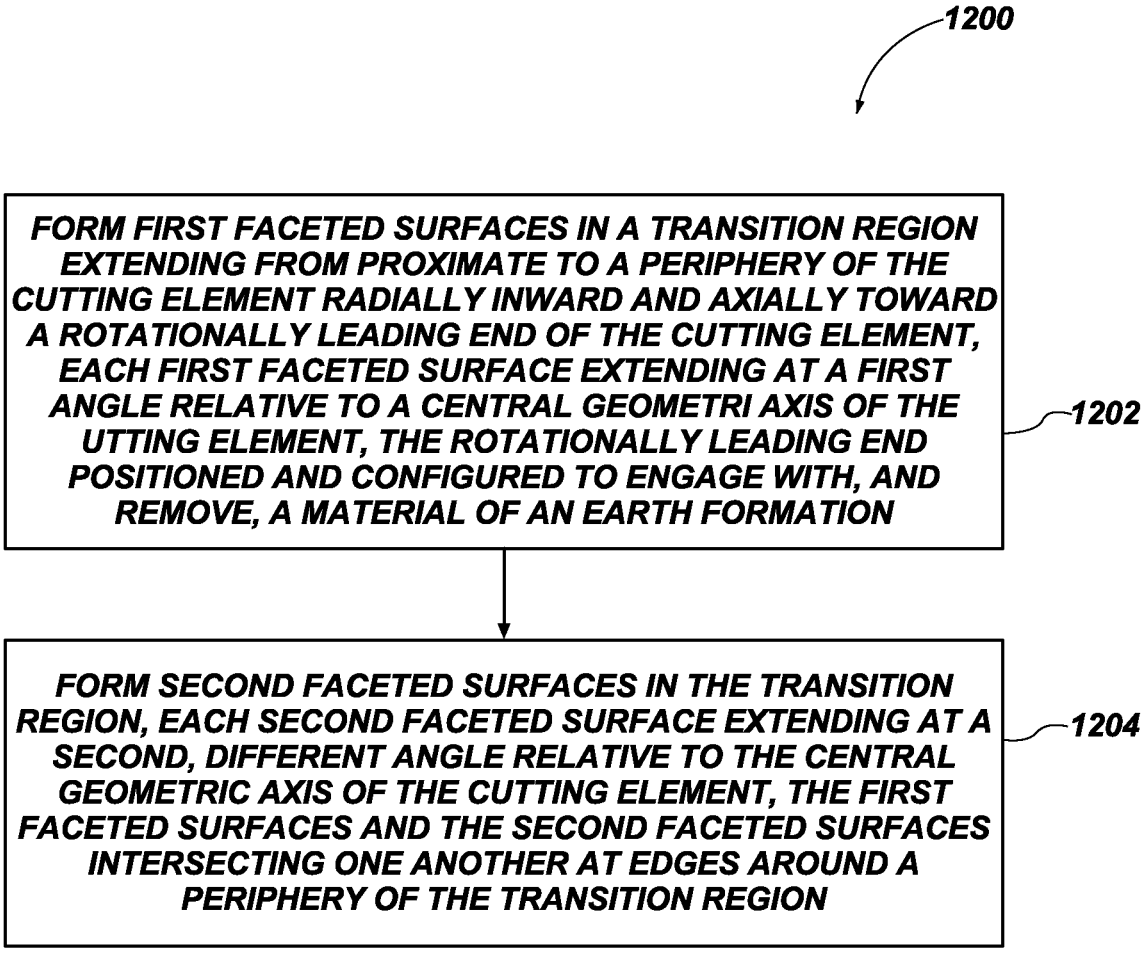
FIG. 12 is a flowchart of a method of making a cutting element in accordance with this disclosure.

FIG. 12 is a flowchart of a method 1200 of making a cutting element in accordance with this disclosure. The method 1200 may involve, for example, forming first faceted surfaces in a transition region extending from proximate to a periphery of the cutting element radially inward and axially toward a rotationally leading end of the cutting element, as shown at act 1202. Each first faceted surface may extend at a first angle relative to a central geometric axis of the cutting element. The rotationally leading end may be positioned and configured to engage with, and remove, a material of an earth formation.

The method 1200 may also involve forming second faceted surfaces in the transition region, each second faceted surface extending at a second, different angle relative to the central geometric axis of the cutting element, as shown at act 1204. The first faceted surfaces and the second faceted surfaces may intersect one another at edges around a periphery of the transition region.

In some embodiments, forming the first faceted surfaces and the second faceted surfaces in the transition region may involve utilizing subtractive manufacturing to form the first faceted surfaces and the second faceted surfaces in the transition region. For example, grinding, honing, laser machining, water jet machining, or other subtractive manufacturing processes suitable for removing the materials of cutting elements known in the art may be utilized to form, shape, and position first faceted surfaces and second faceted surfaces in a transition region of a cutting element.

In other embodiments, forming the first faceted surfaces and the second faceted surfaces in the transition region may involve forming the first faceted surfaces and the second faceted surfaces in the transition region while sintering a material of the cutting element. For example, an inverse shape of the transition region, including the first faceted surfaces and the second faceted surfaces may be provided in a mold for receiving a precursor material or materials of the cutting element, and those materials may be affixed in place to form the transition region, including the first faceted surfaces and the second faceted surfaces, during a sintering process (e.g., an HTHP process).

Figure 13:
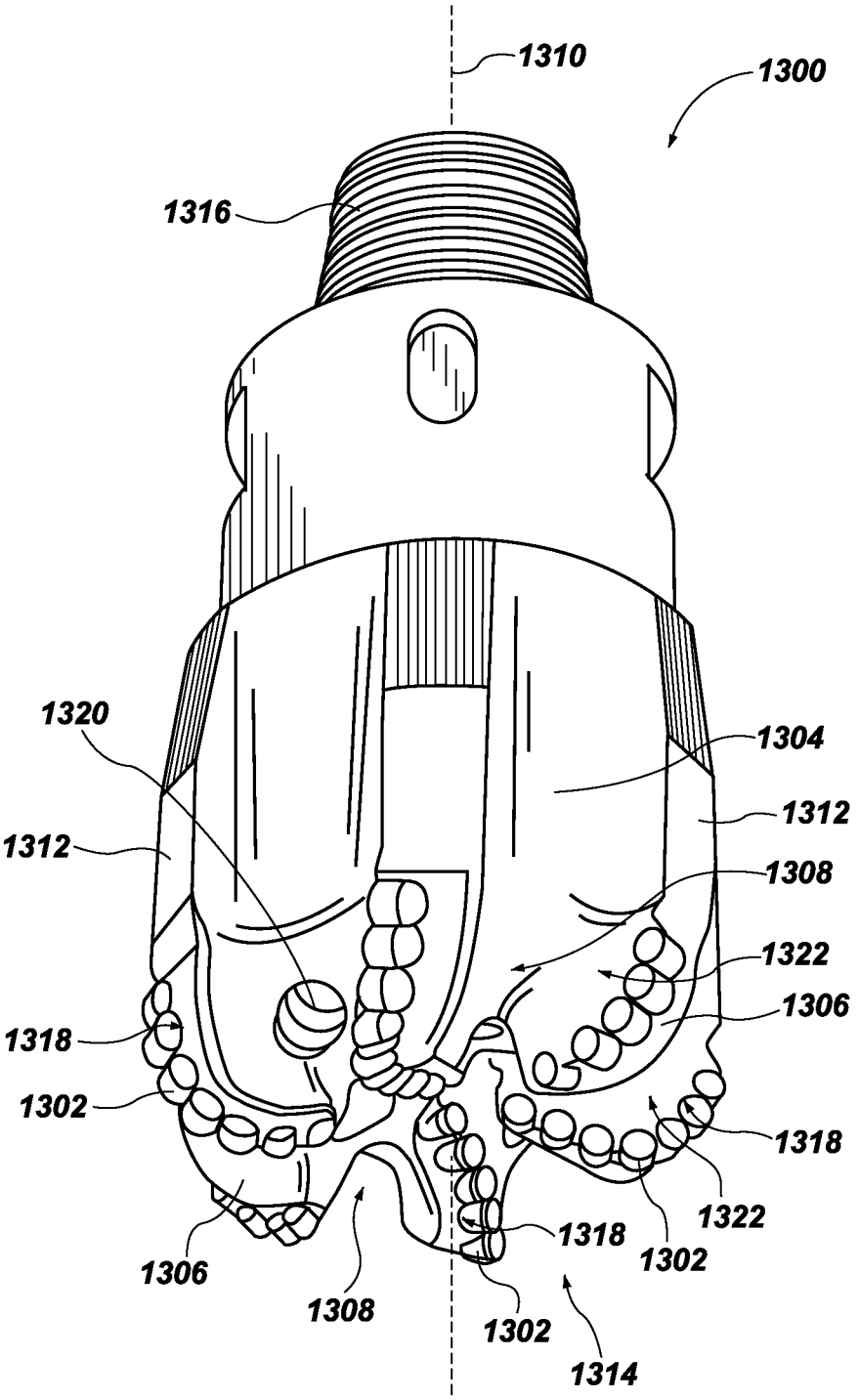
FIG. 13 is a perspective side view of an earth-boring tool including one or more cutting elements in accordance with this disclosure.

FIG. 13 is a perspective side view of an earth-boring tool 1300 including one or more cutting elements 1302 in accordance with this disclosure. The earth-boring tool 1300 may include a body 1304 having cutting elements 1302 secured to the body 1304. The earth-boring tool 1300 shown in FIG. 13 may be configured as a fixed-cutter drill bit, but other earth-boring tools having cutting elements 1302 secured to a body may be employed, such as, for example, those discussed previously in connection with the term "earth-boring tool." The earth-boring tool 1300 may include blades 1306 extending outward from a remainder of the body 1304, with junk slots 1308 being located rotationally between adjacent blades 1306. The blades 1306 may extend radially from proximate an axis of rotation 1310 of the earth-boring tool 1300 to a gage region 1312 at a periphery of the earth-boring tool 1300. The blades 1306 may extend longitudinally from a face 1314 at a leading end of the earth-boring tool 1300 to the gage region 1312 at the periphery of the earth-boring tool 1300. The earth-boring tool 1300 may include a shank 1316 at a trailing end of the earth-boring tool 1300 longitudinally opposite the face 1314. The shank 1316 may have a threaded connection portion, which may conform to industry standards (e.g., those promulgated by the American Petroleum Institute (API)), for attaching the earth-boring tool 1300 to a drill string.

The cutting elements 1302 may be secured within pockets 1318 formed in the blades 1306. Nozzles 1320 located in the junk slots 1308 may direct drilling fluid circulating through the drill string toward the cutting elements 1302 to cool the cutting elements 1302 and remove cuttings of earth material. The cutting elements 1302 may be positioned to contact, and remove, an underlying earth formation in response to rotation of the earth-boring tool 1300 when weight is applied to the earth-boring tool 1300. One or more of the cutting elements 1302 secured to the earth-boring tool 1300 may include transition region geometries, as described throughout this disclosure. For example, cutting elements 1302 in accordance with this disclosure may be primary or secondary cutting elements (i.e., may be the first or second surface to contact an underlying earth formation in a given cutting path), and may be located proximate a rotationally leading surface 1322 of a respective blade 1306 or may be secured to the respective blade 1306 in a position rotationally trailing the rotationally leading surface 1322.

Cutting elements having transition regions including faceted surfaces may, for example, exhibit longer useful life, exhibit higher durability, and require lower energy input to achieve a target depth of cut and/or rate of penetration. More specifically, cutting elements having transition regions including faceted surfaces extending at different angles may have higher efficiency, enabling the cutting elements to achieve target performance for a longer period of time and with less energy input when compared to conventional geometries for cutting elements.

Additional, illustrative embodiments within the scope of this disclosure include, but are not limited to, the following:

Embodiment 1: A cutting element for an earth-boring tool, comprising: a rotationally leading end positioned and configured to engage with, and remove, a material of an earth formation; and a transition region extending from proximate to a periphery of the cutting element radially inward and axially toward the rotationally leading end, the transition region comprising: first faceted surfaces, each first faceted surface extending at a first angle relative to a plane perpendicular to a central geometric axis of the cutting element; and second faceted surfaces, each second faceted surface extending at a second, different angle relative to the plane perpendicular to the central geometric axis of the cutting element, the first faceted surfaces and the second faceted surfaces intersecting one another at edges around a periphery of the transition region.

Embodiment 2: The cutting element of Embodiment 1, wherein the first transition region extends from a cutting edge defined at an intersection of the transition region with a cutting face at the rotationally leading end, a perimeter of the cutting edge defining a polygonal shape.

Embodiment 3: The cutting element of Embodiment 2, wherein the polygonal shape defined by the cutting edge at the intersection between the cutting face and the transition region comprises a hexagon, octagon, or decagon.

Embodiment 4: The cutting element of Embodiment 2 or Embodiment 3, wherein a number of the first faceted surfaces is equal to a number of sides of the polygonal shape and a number of the second faceted surfaces is equal to the number of nodes of the polygonal shape.

Embodiment 5: The cutting element of any one of Embodiments 2 through 4, wherein each first faceted surface extends from a respective side of the polygonal shape, and each second faceted surface extending from a respective node of the polygonal shape.

Embodiment 6: The cutting element of any one of Embodiments 1 through 5, further comprising another transition region extending from the periphery of the cutting element radially inward to the transition region, the other transition region comprising another transition surface oriented at a third angle, different from the first angle and the second angle, relative to the central geometric axis of the cutting element.

Embodiment 7: The cutting element of Embodiment 6, wherein each first faceted surface extends radially outward and axially away from the rotationally leading end to the other transition region and each second faceted surface extends radially outward and axially away from the rotationally leading end to the periphery of the cutting element.

Embodiment 8: The cutting element of Embodiment 6 or Embodiment 7, wherein the other transition region is discontinuous about the periphery of the cutting element.

Embodiment 9: The cutting element of Embodiment 6, wherein each first faceted surface and each second faceted surface extends radially outward and axially away from the rotationally leading end to the other transition region.

Embodiment 10: The cutting element of Embodiment 6 or Embodiment 9, wherein the other transition region is continuous about the periphery of the cutting element.

Embodiment 11: The cutting element of any one of Embodiments 6 through 10, wherein an axial thickness of the other transition region varies around a perimeter of the other transition region.

Embodiment 12: The cutting element of any one of Embodiments 1 through 11, further comprising a recess located proximate to the central geometric axis of the cutting element and extending from the rotationally leading end toward a rotationally trailing end of the cutting element.

Embodiment 13: The cutting element of Embodiment 12, wherein the recess comprises third faceted surfaces distributed around the central geometric axis.

Embodiment 14: The cutting element of Embodiment 12 or Embodiment 13, wherein a shape of a perimeter of the recess is different from a shape of a perimeter of the cutting element.

Embodiment 15: The cutting element of any one of Embodiments 1 through 14, wherein the first angle is between about 10 degrees and about 65 degrees.

Embodiment 16: The cutting element of any one of Embodiments 1 through 15, wherein the second angle is greater than the first angle, and wherein the second angle is between about 20 degrees and about 75 degrees.

Embodiment 17: An earth-boring tool, comprising: cutting elements secured to a body, at least one of the cutting elements comprising: a rotationally leading end positioned and configured to engage with, and remove, a material of an earth formation; and a transition region extending from proximate to a periphery of the cutting element radially inward and axially toward the rotationally leading end, the transition region comprising: first faceted surfaces, each first faceted surface extending at a first angle relative to a central geometric axis of the cutting element; and second faceted surfaces, each second faceted surface extending at a second, different angle relative to the central geometric axis of the cutting element, the first faceted surfaces and the second faceted surfaces intersecting one another at edges around a periphery of the transition region.

Embodiment 18: A method of making a cutting element for an earth-boring tool, comprising: forming first faceted surfaces in a transition region extending from proximate to a periphery of the cutting element radially inward and axially toward a rotationally leading end of the cutting element, each first faceted surface extending at a first angle relative to a central geometric axis of the cutting element, the rotationally leading end positioned and configured to engage with, and remove, a material of an earth formation; and forming second faceted surfaces in the transition region, each second faceted surface extending at a second, different angle relative to the central geometric axis of the cutting element, the first faceted surfaces and the second faceted surfaces intersecting one another at edges around a periphery of the transition region.

Embodiment 19: The method of Embodiment 18, wherein forming the first faceted surfaces and the second faceted surfaces in the transition region comprises utilizing subtractive manufacturing to form the first faceted surfaces and the second faceted surfaces in the transition region.

Embodiment 20: The method of Embodiment 18, wherein forming the first faceted surfaces and the second faceted surfaces in the transition region comprises forming the first faceted surfaces and the second faceted surfaces in the transition region while sintering a material of the cutting element.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure.

What is claimed is:

1. A cutting element for an earth-boring tool, comprising:

a rotationally leading end positioned and configured to engage with, and remove, a material of an earth formation; and a transition region extending from proximate to a periphery of the cutting element radially inward and axially toward the rotationally leading end and to a cutting edge defined at an intersection of the transition region with a cutting face at the rotationally leading end, a perimeter of the cutting edge defining a polygonal shape, the transition region comprising:

first faceted surfaces, each first faceted surface extending at a first angle relative to a central geometric axis of the cutting element; and second faceted surfaces, each second faceted surface extending at a second, different angle relative to the central geometric axis of the cutting element, the first faceted surfaces and the second faceted surfaces intersecting one another at edges around a periphery of the transition region;

wherein a number of the first faceted surfaces is equal to a number of sides of the polygonal shape and a number of the second faceted surfaces is equal to a number of nodes of the polygonal shape.

2. The cutting element of claim 1, wherein the polygonal shape defined by the cutting edge at the intersection between the cutting face and the transition region comprises a hexagon, octagon, or decagon.

3. The cutting element of claim 1, wherein each first faceted surface extends from a respective side of the polygonal shape, and each second faceted surface extends from a respective node of the polygonal shape.

4. The cutting element of claim 1, further comprising another transition region extending from the periphery of the cutting element radially inward to the transition region, the another transition region comprising another transition surface oriented at a third angle, different from the first angle and the second angle, relative to the central geometric axis of the cutting element.

5. The cutting element of claim 4, wherein each first faceted surface extends radially outward and axially away from the rotationally leading end to the othew another transition region and each second faceted surface extends radially outward and axially away from the rotationally leading end to the periphery of the cutting element.

6. The cutting element of claim 4, wherein the another transition region is discontinuous about the periphery of the cutting element.

7. The cutting element of claim 4, wherein each first faceted surface and each second faceted surface extends radially outward and axially away from the rotationally leading end to the another transition region.

8. The cutting element of claim 4, wherein the another transition region is continuous about the periphery of the cutting element.

9. The cutting element of claim 4, wherein an axial thickness of the another transition region varies around a perimeter of the another transition region.

10. The cutting element of claim 1, further comprising a recess located proximate to the central geometric axis of the cutting element and extending from the rotationally leading end toward a rotationally trailing end of the cutting element.

11. The cutting element of claim 10, wherein the recess comprises third faceted surfaces distributed around the central geometric axis.

12. The cutting element of claim 10, wherein a shape of a perimeter of the recess is different from a shape of a perimeter of the cutting element.

13. The cutting element of claim 1, wherein the first angle is between about 10 degrees and about 65 degrees.

14. The cutting element of claim 1, wherein the second angle is greater than the first angle, and wherein the second angle is between about 20 degrees and about 75 degrees.

15. An earth-boring tool, comprising:

cutting elements secured to a body, at least one of the cutting elements comprising:

a rotationally leading end positioned and configured to engage with, and remove, a material of an earth formation; and a transition region extending from proximate to a periphery of the cutting element radially inward and axially toward the rotationally leading end and to a cutting edge defined at an intersection of the transition region with a cutting face at the rotationally leading end, a perimeter of the cutting edge defining a polygonal shape, the transition region comprising:

first faceted surfaces, each first faceted surface extending at a first angle relative to a central geometric axis of the cutting element; and second faceted surfaces, each second faceted surface extending at a second, different angle relative to the central geometric axis of the cutting element, the first faceted surfaces and the second faceted surfaces intersecting one another at edges around a periphery of the transition region;

wherein a number of the first faceted surfaces is equal to a number of sides of the polygonal shape and a number of the second faceted surfaces is equal to a number of nodes of the polygonal shave.

16. A method of making a cutting element for an earth-boring tool, comprising:

forming first faceted surfaces in a transition region extending from proximate to a periphery of the cutting element radially inward and axially toward a rotationally leading end of the cutting element and to a cutting edge defined at an intersection of the transition region with a cutting face at the rotationally leading end, a perimeter of the cutting edge defining a polygonal shape, each first faceted surface extending at a first angle relative to a central geometric axis of the cutting element, the rotationally leading end positioned and configured to engage with, and remove, a material of an earth formation, a number of the first faceted surfaces being equal to a number of sides of the polygonal shape; and forming second faceted surfaces in the transition region, each second faceted surface extending at a second, different angle relative to the central geometric axis of the cutting element, the first faceted surfaces and the second faceted surfaces intersecting one another at edges around a periphery of the transition region, a number of the second faceted surfaces being equal to a number of nodes of the polygonal shape.

17. The method of claim 16, wherein forming the first faceted surfaces and the second faceted surfaces in the transition region comprises utilizing subtractive manufacturing to form the first faceted surfaces and the second faceted surfaces in the transition region.

18. The method of claim 16, wherein forming the first faceted surfaces and the second faceted surfaces in the transition region comprises forming the first faceted surfaces and the second faceted surfaces in the transition region while sintering a material of the cutting element.

* * * * *